US008442228B2

(12) United States Patent
Staehly

(10) Patent No.: US 8,442,228 B2
(45) Date of Patent: May 14, 2013

(54) MULTI-CLASS SWITCHING SYSTEM AND ASSOCIATED METHOD OF USE

(75) Inventor: Joseph F. Staehly, Liberty, NC (US)

(73) Assignee: MicroTechnologies LLC, Vienna, VA (US)

( * ) Notice: Subject to any disclaimer, the term of this patent is extended or adjusted under 35 U.S.C. 154(b) by 231 days.

(21) Appl. No.: 13/080,430

(22) Filed: Apr. 5, 2011

(65) Prior Publication Data

US 2011/0243329 A1 Oct. 6, 2011

Related U.S. Application Data

(60) Provisional application No. 61/321,313, filed on Apr. 6, 2010.

(51) Int. Cl.
*H04K 1/00* (2006.01)

(52) U.S. Cl.
USPC ..... 380/256; 380/212

(58) Field of Classification Search ..... 726/26, 726/27, 28, 30, 31; 713/300, 189, 171; 380/256, 380/312, 200, 44, 255; 370/260, 230.1, 352, 370/402, 264, 353; 348/E7.056, E5.008, 348/E7.082
See application file for complete search history.

(56) References Cited

U.S. PATENT DOCUMENTS

| | | | | |
|---|---|---|---|---|
| 5,434,920 | A | 7/1995 | Cox et al. | |
| 7,283,743 | B2 | 10/2007 | Matz et al. | |
| 7,477,614 | B2 * | 1/2009 | Hansen | 370/264 |
| 7,533,259 | B2 | 5/2009 | Anspach | |
| 7,623,149 | B2 | 11/2009 | Winegard | |
| 8,027,473 | B2 * | 9/2011 | Stiscia et al. | 380/256 |
| 2002/0031126 | A1 | 3/2002 | Crichton et al. | |
| 2004/0068655 | A1 * | 4/2004 | Nishimura et al. | 713/171 |
| 2005/0243742 | A1 * | 11/2005 | Hansen | 370/264 |
| 2006/0109982 | A1 * | 5/2006 | Puiatti et al. | 380/200 |
| 2007/0124821 | A1 * | 5/2007 | Saito | 726/27 |
| 2008/0022120 | A1 | 1/2008 | Factor et al. | |
| 2008/0095079 | A1 * | 4/2008 | Barkley et al. | 370/260 |
| 2008/0310436 | A1 * | 12/2008 | Bareis | 370/402 |
| 2009/0109959 | A1 * | 4/2009 | Elliott et al. | 370/352 |
| 2009/0157936 | A1 * | 6/2009 | Goss et al. | 710/264 |
| 2009/0251529 | A1 | 10/2009 | Tucker et al. | |
| 2009/0257588 | A1 * | 10/2009 | Ayaki et al. | 380/212 |

(Continued)

OTHER PUBLICATIONS

Zhong et al., "Advanced Optical-Label Routing System Supporting Multicast, Optical TTL, and Multimedia Applications", Journal of Lightwave Technology (IEEE), Oct. 2005.

*Primary Examiner* — Jeffrey Pwu
*Assistant Examiner* — Nega Woldemariam
(74) *Attorney, Agent, or Firm* — Thompson Coburn LLP

(57) ABSTRACT

A multi-class switching system that includes a coder/decoder for converting voice between analog and digital; a first switch coupled to the coder/decoder to isolate non-secure entities in a dial-up network, including fiber optic ports to pass classified and unclassified data to one of a classified IP network and an unclassified IP network, an encryption device coupled to the first switch to encrypt digitized voice, a second switch coupled to the encryption device and directly to the first switch, wherein the second switch receives encrypted digital voice from the encryption device connection and unencrypted digital voice from the direct connection, and wherein the first switch and the second switch operate in a plurality of states including secure, non-secure, and cut-off, a fiber optic (F/O) switch coupled to the coder/decoder, and at least one controller to control states of the first switch, the second switch, and the fiber optic (F/O) switch.

6 Claims, 5 Drawing Sheets

U.S. PATENT DOCUMENTS

2010/0182395 A1 7/2010 Delhoyo
2010/0241748 A1 9/2010 Ansari et al.
2010/0271944 A1* 10/2010 Michaelis et al. ..... 370/230.1
2011/0035472 A1 2/2011 Tucker et al.
2011/0069144 A1 3/2011 Tucker
2011/0086614 A1* 4/2011 Brisebois et al. ..... 455/411
2011/0087879 A1 4/2011 Chand et al.
2011/0292206 A1 12/2011 Newton

* cited by examiner

MULTI-CLASS SWITCHING SYSTEM AND ASSOCIATED METHOD OF USE

CROSS-REFERENCE AND PRIORITY CLAIM TO RELATED APPLICATION

This patent application claims priority to provisional U.S. Patent Application Ser. No. 61/321,313, filed Apr. 6, 2010, and entitled "Multi-Class Switching System and Method", the entire disclosure of which is incorporated herein by reference.

BACKGROUND OF THE INVENTION

Industry and Government agencies are migrating away from integrated services digital network (ISDN) technology at video teleconference (VTC) endpoints. ISDN is a set of communications standards for simultaneous digital transmission of voice, video, data, and other network services over the traditional circuits of the public switched telephone network. In the new communications environment, switching devices will be directed to connecting two or more IP networks of varying classification. This new communication environment, and associated switching system, particularly when used by the military, security, and intelligences services, requires extraordinary means to ensure communications security.

A number of Federal agencies are involved in certifying and validating hardware and software used in these communications systems so that such security can be insured. Use of the Internet has compounded the difficulty in ensuring this security, and has required rigorous testing regimes and complex designs for such communications system. Further aggravating the security issue is the movement toward a converged communications system—one in which all video, data, and voice communications flow though a common (and digital) gateway. A common reference for such a converged communications system in U.S. military circles is a net-centric system, which is intended to support Network Centric Warfare (NCW).

Part of a converged communications system involves Voice Over Internet Protocol (VoIP), a technology that is a critical component of NCW, and is associated with potential command center desk top convergence, mobility enhancements, infrastructure reduction and multi-media collaboration. Implementing VoIP is a critical step to effectively converge all communications traffic (data, voice, video, etc.) onto an IP network that is central to effective NCW.

SUMMARY OF THE INVENTION

The present invention relates to a multi-class switching system that includes a coder/decoder for converting voice between analog and digital; a first switch, e.g., red switch, coupled to the coder/decoder to isolate non-secure entities in a dial-up network and includes fiber optic ports to pass classified and unclassified data to one of a classified IP network and an unclassified IP network, an encryption device coupled to the first switch, e.g., red switch, to encrypt digitized voice, a second switch, e.g., black switch, coupled to the encryption device and directly to the first switch, e.g., red switch, wherein the second switch, e.g., black switch, receives encrypted digital voice from the encryption device connection and unencrypted digital voice from the direct connection, and wherein the first switch, e.g., red switch, and the second switch, e.g., black switch, operate in a plurality of states including secure, non-secure, and cut-off. There is a fiber optic (F/O) switch coupled to the coder/decoder, and at least one controller that includes a state control module, power-on/off logic, network cut-off logic, and remote control logic to control states of the first switch, e.g., red switch, the second switch, e.g., black switch, and the fiber optic (F/O) switch. The controller stores and retrieves sensitive coder/decoder parameters for operation of the coder/decoder, wherein the secure storage controller accesses the coder/decoder only when the first switch, e.g., red switch, and the second switch, e.g., black switch, both are in the cut-off state.

BRIEF DESCRIPTION OF THE DRAWINGS

In the drawings, which are not necessarily drawn to scale or with correct proportions, like numerals describe substantially similar components throughout the several views. The drawings illustrate generally, by way of example, but not by way of limitation, various embodiments discussed in the present document.

DETAILED DESCRIPTION OF THE INVENTION

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be used, or structural and logical changes may be made without departing from the scope of the present invention. The following detailed description is, therefore, not to be taken in a limiting sense, and the scope of the present invention is defined by the appended claims and their equivalents. In this document, the terms "a" or "an" are used to include one or more than one and the term "or" is used to refer to a nonexclusive "or" unless otherwise indicated. In addition, it is to be understood that the phraseology or terminology employed herein, and not otherwise defined, is for the purpose of description only and not of limitation.

Figure 1:
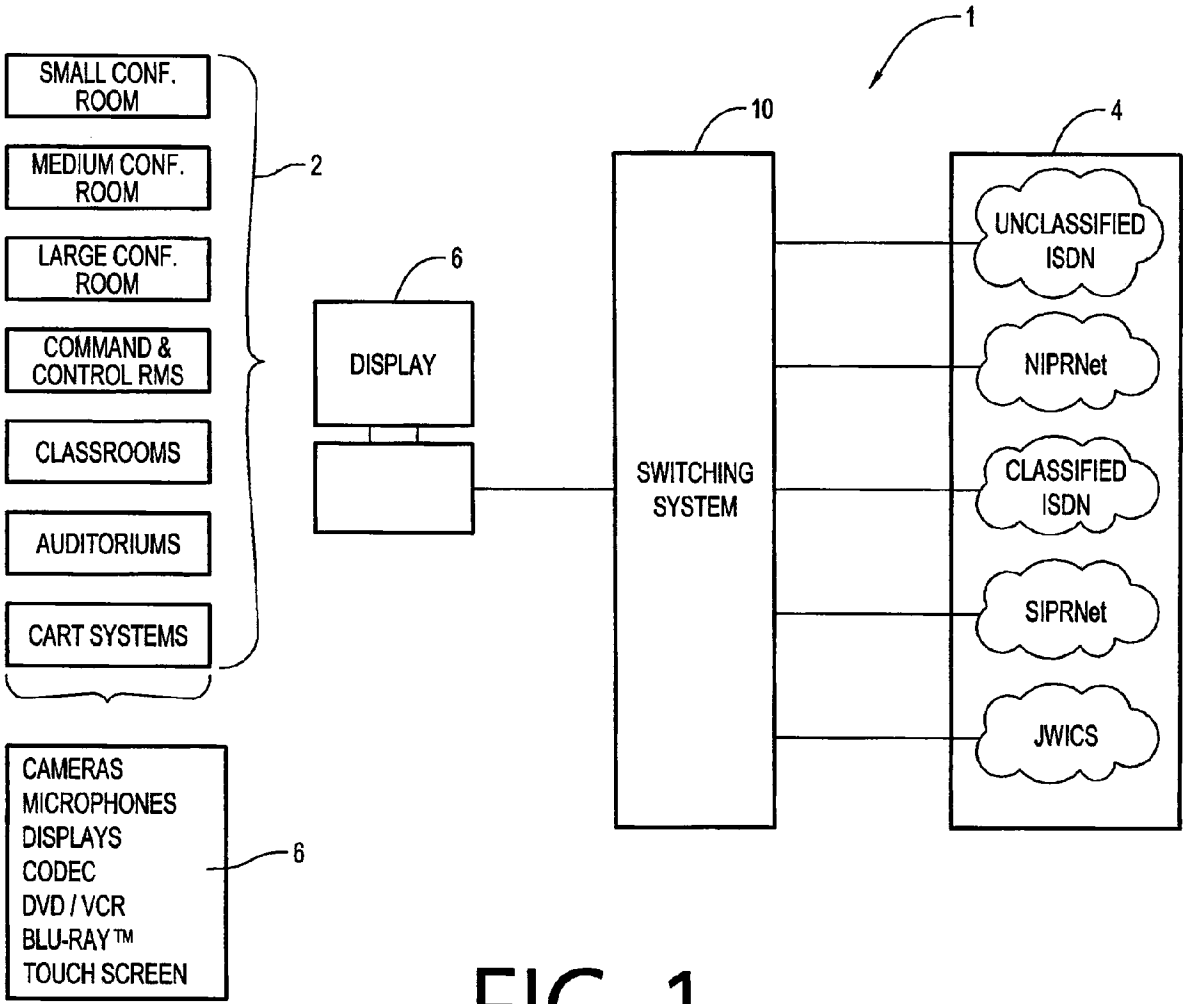
FIG. 1 illustrates a converged communication environment in which a multi-class switching system is implemented.

FIG. 1 shows a converged communications environment 1 for controlling and enforcing security of certain communications over a number of networks. The environment includes a number of "rooms" 2 that may communicate through an exemplary multi-class switching system 10 to other entities using one or more notional domains, or networks 4 (five are shown). Examples of the notional domains include unclassified ISDN, NIPRNet, Classified ISDN, SIPRNet, and JWICS. The Secret Internet Protocol Router Network (SIPRNet) is a system of interconnected computer networks used by the U.S. Department of Defense (DoD) and the U.S. Department of State to transmit classified information (up to and including information classified SECRET) via the TCP/IP protocol suite in a secure environment. SIPRNet also provides services such as hypertext document access and electronic mail. As such, SIPRNet, together with its counterpart, the TOP SECRET and SCI Joint Worldwide Intelligence Communications System (JWICS), is the DoD's classified version of the public Internet.

The Non-classified Internet Protocol Router Network (NIPRNet) is used to exchange sensitive but unclassified information between "internal" users, as well as providing users, access to the Internet. NIPRNet is composed of Internet Protocol routers owned by the DoD. NIPRNet was created by the Defense Information Systems Agency (DISA) to supersede earlier networks. NIPRNet is, by design, a parallel air gapped analog to the SIPRNet, providing seamless interoperability for unclassified combat support applications, as well as providing a gateway to the public Internet. (An air gap is a security measure often taken for computers and computer networks that must be extraordinarily secure. The air gap ensures that a secure network is completely physically, electrically, and electromagnetically isolated from non-secure networks, such as the public Internet or a non-secure local area network. Limitations imposed on devices used in these environments may include a ban on wireless connections to or from the secure network or similar restrictions on electromagnetic leakage from the secure network through the use of TEMPEST or a Faraday cage. In environments where networks or devices are rated to handle different levels of classified information, the two (dis)-connected devices/networks are referred to as "low side" and "high side," low being unclassified and high referring to classified, or classified at a higher level. This is also occasionally referred to as red or high (classified) and black or low (unclassified). To move data from the high (red) side to the low (black) side, it is necessary to write data to a physical medium, and the data to a device on the latter network. Data can move low-to-high with minimal processes while high-to-low requires much more stringent procedures to ensure protection of the data at a higher level of classification.

Each of the "rooms" 2 may include specific communications components or processes 6, including cameras, microphones, displays, CODECS, DVD/VCR(s), Blu-Ray™ components, and touch screens(s).

The environment 1 also may connect communications points (not shown), that are fixed or mobile, distributed or centralized. For example, the "room" 2 may be implemented in a self-propelled vehicle, and may be used to communicate with other mobile assets and with fixed assets. The "room" 2 may communicate with other communications centers and communicate with, or control the communication to, from, and among less capable units, such as individual communications devices. Such individual communications devices include computers, telephones (fixed and mobile), radios, and any other communications device. The individual communications devices may be installed in any combination in one or more of the mobile and fixed assets.

The controlled communications include voice, voice over IP (VoIP), data, and video. The communications means include wired communications using fiber optic, cable, and copper means. For example, the environment 1 may involve video conferencing among a number of distributed computers connected through a fiber optic network. The communications may be classified or unclassified, requiring a corresponding secure mode of communications and a corresponding non-secure mode of communications.

Within the environment 1, control of the communications, including communications security, is effected by the switching system 10. Switching system 10 includes specific hardware devices, including switches, routers, modems, wiring, cabling and other signaling means, decoders, controllers, processors, storage units and interfaces. The switching system 10 also includes programming, embodied as software, hardware, or firmware, or any combination of software, hardware, or firmware, on one or more of the hardware devices or processors, as appropriate to support the functioning of the hardware devices.

Figure 2:
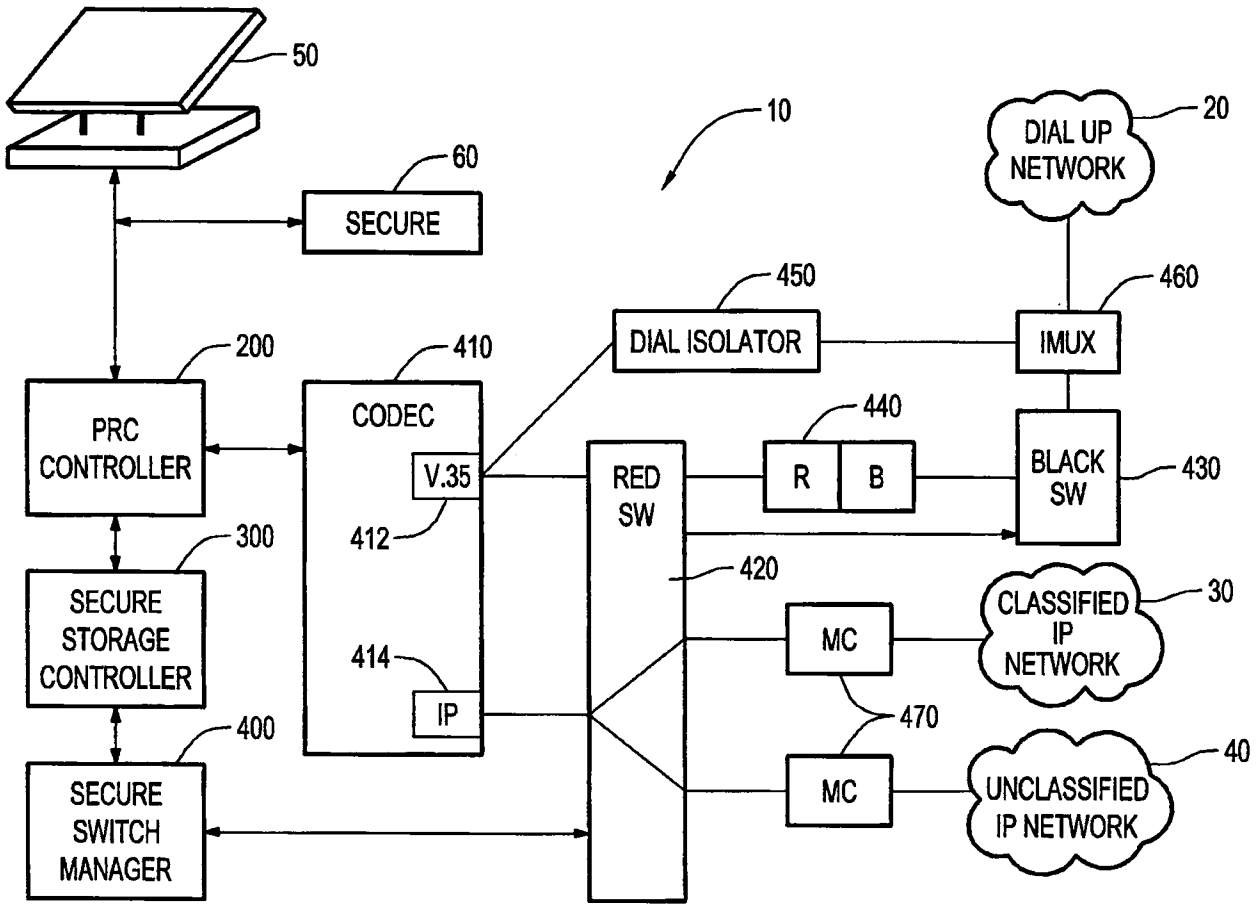
FIG. 2 illustrates in block diagram form, an exemplary multi-class switching system installed in the converged communications environment of FIG. 1.

FIG. 2 is a block diagram of the exemplary switching system 10 for use in the converged communications environment of FIG. 1. The switching system 10 provides the following five features:

1. Secure IP telephony, supporting encrypted voice/IP data and video communications on the same terminal, and that preferably: (a) complies with NATO SCIP standards; (b) supports National and NATO encryption algorithms; (c) supports H.323 and SIP signaling protocols; (d) is compliant with COTS and NATO SCIP IP telephone systems; (e) is compliant with Network Centric Warfare Concepts; and (f) is compliant with TACOMS Post 2000 criteria.

2. Tactical IP Switches that are: (a) based on IP concepts; (b) support H.323 and SIP signaling protocols; (c) use F/O Gbit Ethernet Interface for the connection to other switches; (d) use 10/100 Base-T Ethernet interfaces to form high speed LANs; and (e) have H.323 Gatekeeper and SIP proxy server capabilities for management purposes of the VoIP call control functions.

3. Gateway functions developed on switches to allow end-to-end encrypted voice calls between secure IP telephones and circuit switched voice terminals (ISDN, PSTN Network users).

4. E1/E2/E3 for connections to LAN/WANs and connections between tactical IP switches.

5. ISDN PRI (DSS1 ITU Q.931 Signaling) for ISDN switch connections; V.35 for LAN/WAN, router connections; and radio interface (Combat Net Radio (CNR) Gateway Interface) for CNR radio connections.

As can be seen in FIG. 2, switching system 10 interfaces include a man-machine interface (touch panel 50), a signage panel 60 (e.g., a LED display), network interfaces (IMUX 460), and other interfaces, all of which may be used to link to a number of different networks (or domains). The networks include dial-up network 20, classified IP network 30, and unclassified network 40. Other network types may be part of the converged communications environment 1 (see FIG. 1).

The switches include a first switch, e.g., red switch, 420 and second switch, e.g., black switch, 430. (Red and black are preferably used to refer respectively to secure and non-secure communications.) The controllers and processors include primary room controller (PRC) 200, secure storage controller (SSC) 300, and secure switch manager (SSM) 400. The controllers communicate with certain of the other system 10 components using RS-232 protocols, for example.

Certain of the hardware devices illustrated in FIG. 2 may be rack-mounted in a single rack (not shown) or in multiple racks. The hardware devices may be electrically coupled for signaling purposes by wiring bundles or backplanes, or a combination of wiring bundles, cables, and backplanes. These coupling means may include shielding to eliminate the threat posed by EMI, and to prevent possible "eavesdropping." These coupling means include fiber optic (F/O) cable as well as conventional copper wire.

As can be appreciated from FIG. 2, the switching system 10 can operate in a secure mode and a non-secure mode. Within the secure mode, the system 10 may invoke two or more sub-modes. For example, the system 10 may provide for default operation in SECURE, SECRET, SECRET SAP, TOP SECRET, AND TOP SECRET SCI sub-modes. Selection of such sub-modes for operation of the system 10 may be by way of a user-entered choice. The thus-selected sub-mode may be displayed on the signage panel 60. The touch panel 50 allows the user to enter a user-defined choice (e.g., CLASSIFIED) for operation of the system 10, and subsequent display on the signage panel 60.

The switching system 10 non-secure default sub-modes of operation may include UNCLASSIFIED and MEETING IN PROGRESS. As with the secure mode, the non-secure mode allows a user-defined choice of operation, entered from the touch panel 50. For example, if the user wants the signage panel 60 to show NON-SECURE, the user simply enters this choice from the touch panel 50.

In selecting sub-modes of operation, and for display of such sub-modes on the signage panel 60, the user may make entries using a pull-down menu, a soft key pad, or any other well-known means for entering a choice on a touch screen.

The signage panel 60 also may be used for other purposes, including display of a microphone (MIC) MUTE status.

The PRC 200 also includes the hardware and programming (software and firmware) needed to invoke the various control functions available to a human user by way of the touch panel 50. The PRC 200 controls the I/O, RS-232 and relays for operating the switching system 10 and for communications room operations.

The secure storage controller 300 (SSC) is used for storing and retrieving sensitive CODEC parameters. Table 1 presents a nonexclusive listing of such CODEC parameters.

TABLE 1

CODEC PARAMETERS

| Parameter | Notes |
|---|---|
| DHCP/static | Defines whether to use DHCP or Static IP assignment. This configuration only applies to IPv4. |
| IP address | Defines the IPv4 IP address to use. Only applicable if Static IP assignment is being used. |
| IP subnet | Defines the subnet mask. Only applicable if Static IP assignment is being used. |
| IP gateway | Defines the IP gateway. Only applicable if Static IP assignment is being used. |
| IP DNS #1 | Defines the network addresses for DNS servers. Up to 5 addresses may be specified. |
| IP DNS #2 | Defines the network addresses for DNS servers. Up to 5 addresses may be specified. |
| External Services | Mode: <On/Off> Enables/disables External Services. External Services allows a third party integrator to present services on the unit using XHTML 1.0 strict and HTTP. If turned on, a menu choice will appear in the services menu, and entering this the TANDBERG unit will retrieve a default XHTML page as specified in the External Services configuration menu. |
| External Services IP Address | Configures the External Services IP Address. |
| Corporate Directory | Mode: <On/Off> Enables/disables use of a Corporate Directory stored on a remote server. |
| Corporate Directory IP Address | Specifies the IP address to the server where the Corporate Directory is located. Example: xconfiguration corporatedirectory address: 10.47.6.75 |
| H.323 Call Mode | Mode: <Direct/Gatekeeper/CallManager> Defines how to establish H.323 calls. Direct: An IP address must be used in order to make a H.323 call. The system will not use a gatekeeper or CallManager. Gatekeeper: The system will use a gatekeeper to make a H.323 call. CallManager: The system will use a CallManager to make a H.323 call. Direct H.323 calls can be made even though the H.323CallSetup Mode is set to Gatekeeper or Callmanager. Example: xConfiguration H.323 CallSetup Mode: Gatekeeper |
| Gatekeeper Mode | Discovery: <Manual/Auto> Auto: The system will automatically try to register to any available gatekeeper. If a gatekeeper responds to the request sent from the CODEC 410 within 30 seconds this specific gatekeeper will be used. This requires auto discovery on the gatekeeper as well. If no gatekeeper responds, the system will not use a gatekeeper for making H.323 calls and hence an IP address must be specified manually. Manual: The system will use a specific gatekeeper identified by H.323 Gatekeeper Address. Example: xconfiguration H.323 Gatekeeper discovery: manual |
| Gatekeeper IP Address | Specifies the IP Address of the Gatekeeper. |
| Call Manager IP Address | Specifies the IP Address of the Call Manager IP address. |
| Site ID | Defines Site ID. |
| E.164 alias | Defines e.164 alias. |
| SNMP mode | Mode: <On/Off/ReadOnly/TrapsOnly> Enables or disables SNMP service. If set to On, both Read and sending of Traps will be enabled. If set to Off, all SNMP functionality will be disabled. ReadOnly: The system will not send SNMP traps, but it will be possible to read data from the SNMP MIB. TrapsOnly: The system will send SNMP traps, but it will not be possible to read data from the SNMP MIB. Example: xconfiguration snmp mode: readonly |
| SNMP #1 IP address | Defines SNMP host addresses. Up to 3 addresses may be specified. Defines the network addresses for DNS servers. Example: xconfiguration snmp hostipaddr: |
| SNMP #2 IP address | Defines SNMP host addresses. Up to 3 addresses may be specified. Defines the network addresses for DNS servers. Example: xconfiguration snmp hostipaddr: |
| External Manager IP address | Specifies the IP address to the External Manager/ Management system. |
| HTTP mode | Mode: <On/Off> Enables or disables HTTP service. |
| HTTPS mode | Mode: <On/Off> Enables or disables HTTPS service. |
| Telnet mode | Mode: <On/Off> Enables or disables Telnet service. |
| SSH mode | Mode: <On/Off> Enables or disables SSH service. |
| FTP mode | Mode: <On/Off> Enables or disables the systems embedded FTP server. |

Thus, the secure storage controller 300 stores IP addressing data and accesses the CODEC 410 to provide the IP addressing data for repopulating the CODEC 410 during a switch between secure and non-secure modes of the system 10, and, as will be discussed below, anytime power is lost to either the first switch, e.g., red switch, 420 or the second switch, e.g., black switch, 430. Moreover, access between the CODEC 410 and the secure storage controller 300 is allowed only when both the first switch, e.g., red switch, 420 and the second switch, e.g., black switch, 430 are in the cut-off state. This access restriction, invoked by programming in the secure storage controller 300 (e.g., the Isolation module 330), or alternatively in the primary room controller 200, prevents any portion of a non-secure network contacting any portion of a secure network.

The secure switch manager (SSM) 400 controls RS-232 communications between the PRC 200 and the SSC 300 and power to the media converters 470. This communications path between the PRC 200 and the SSC 300 is activated only when the switching system 10 is in secure mode. During non-secure operations, the RS-232 path between the PRC 200 and SSC 300 is cut-off. In an embodiment, the SSM 400 has a total of seven (7) isolated form "C" relay outputs (rated at 1 amp @ 120 VAC/28 VDC) that can be activated via positive (+) low current trigger inputs (rated at 3 to 24 VDC @ 2 mA minimum). When applied in two domain IP systems, three outputs will connect or disconnect the Tx, Rx, and Gnd RS-232 connectivity between the PRC 200 and the SSC 300. Two outputs will cut power on or off to the non-secure and secure media converters 470, depending on the selected state.

The first switch, e.g., red switch, 420 and the second switch, e.g., black switch, 430 are dual channel fiber optic (F/O) switching units. Each channel has three position states: SECURE (A) position, NON-SECURE (B) position, and CUT-OFF (C) position. The operational programming of the switches 420 and 430 may be specific per their environment and application. Each channel within a switch 420/430 can be independently controlled by various means of actuation. The means of control include: manual control via front panel push button; contact closure control from a remote set of open/close contacts wired to the remote port of the switch; and RS232 serial command controls as issued from a remote device capable of sending and receiving ASCII characters. Both the first switch, e.g., red switch, 420 and second switch, e.g., black switch, 430 may be certified through common criteria EAL4 testing.

The first switch, e.g., red switch, 420 provides for both RS-530 and IP switching. Channel one (Ch1) allows the user the capability of sharing a single DB25/F interface device connected to the common port among two other DB25/M devices connected to the "SECURE" and "NON-SECURE" DB25 ports. Channel two (Ch2) allows the user the capability of sharing a 10/100 Base-T device connected to the common port among two duplex ST (1300 nm wavelength) Fiber Optic devices connected to SECURE and NON-SECURE Fiber Optic ports. The Fiber Optic ports connect to media converters 470 and the output (i.e., the connection between the red switch 420 and the CODEC 410) of the IP side of the red switch 420 is a copper Ethernet port connecting to the CODEC 410. The output of the red switch 420 does not require a separate media converter because media conversion between fiber and copper takes place in the red switch 420. Because the first switch, e.g., red switch, 420 is TEMPEST approved, fiber optic modems are not needed. Both channels allow the user to set the switches 420 and 430 to the CUT-OFF position, which stops any and all data throughput for the switch. Switching may be controlled locally by manually operating front panel push buttons. Alternatively, the first switch, e.g., red switch, 420 may be controlled remotely using the DB9 Control port located on the rear of the unit using either contact closures or an RS-232 command interface. The switch unit housing the first switch, e.g., red switch, 420 includes front panel LED displays that indicate the respective switch position and unit power status. All ports (SECURE, NON-SECURE, and COMMON) for the first switch, e.g., red switch, 420 are transparent to all data going through that switch. If power to the first switch, e.g., red switch, 420 is removed, both switches 420/430 will be automatically set to the CUT-OFF position. When power is restored, each switch 420 and 430 will move to the programmed default position (see Table 2).

For the second switch, e.g., black switch, 430, channel one allows the user the capability of sharing a single DB25/M interface device connected to the common port among two other DB25/F devices connected to the SECURE and NON-SECURE DB25 ports. Channel two allows the user the capability of sharing a single RJ45 device connected to the common port with two other RJ45 devices connected to the SECURE and NON-SECURE RJ45 ports. Both channels allow the user to set the switches to the CUT-OFF position, which stops any and all data throughput for the switch. The second switch, e.g., black switch, 430, may be controlled locally by manually operating front panel push buttons or remotely from the DB9 Control port located on the rear of the switch unit using either contact closures or an RS-232 command interface. Front panel LED displays indicate the respective switch position and unit power status. All ports (SECURE, NON-SECURE, and COMMON) for the second switch, e.g., black switch, 430, are transparent to all data going through that switch. If power to the second switch, e.g., black switch, 430 is removed, both switches 430 and 420 will be automatically set to the CUT-OFF position. When power is restored, each switch 420/430 will move to the programmed default position (see Table 2).

For the second switch, e.g., black switch 430, channel one allows the user the capability of sharing a single DB25/M interface device connected to the common port among two other DB25/F devices connected to the SECURE and NON-SECURE DB25 ports. Channel two allows the user the capability of sharing a single RJ45 device connected to the common port with two other RJ45 devices connected to the SECURE and NON-SECURE RJ45 ports. Both channels allow the user to set the switches to the CUT-OFF position, which stops any and all data throughput for the switch. The second switch, e.g., black switch 430 may be controlled locally by manually operating front panel push buttons or remotely from the DB9 Control port located on the rear of the switch unit using either contact closures or an RS-232 command interface. Front panel LED displays indicate the respective switch position and unit power status. All ports (SECURE, NON-SECURE, and COMMON) for the second switch, e.g., black switch 430 are transparent to all data going through that switch. If power to the second switch, e.g., black switch 430 is removed, and then restored, it will power up in the CUT-OFF position. If system power is lost, both switches 420/430 will be automatically set to the CUT-OFF position until the PRC initializes each switch 420/430 to the programmed default position (see Table 2).

The CODEC 410 may be implemented as software (i.e., a computer program), as hardware, or both. The CODEC 410 is capable of encoding and decoding a digital data stream or signal. The CODEC 410 as used in the switching system 10 converts audio analog to digital (V.35-412) and computer digital sound back to audio.

The CODEC 410 receives IP addressing data from the SSC 300 during every change of state in the system 10, and every mode change between secure and non secure. The CODEC 410 then reboots, and the desired mode of operation is placed into effect.

Media converters 470 are coupled to the IP side of the red switch 420 as well as to each IP domain (i.e., the IP networks 30 and 40 in FIG. 2). When a specific IP network is not in use, power is removed from the associated media converter 470 by operation of the PRC 200 and SSM 400.

Encryption Device 440 is used to encrypt and decrypt digital voice communications using a NSA-approved encryption algorithm.

Dial isolator 450 is used for secure dialing from the CODEC 410. The isolator 450 provides the necessary separation, e.g., red/black, on the RS-366 communication path.

IMUX 460 enables the RS-530 serial and RS-366 dialing protocols to provide communications to the ISDN network.

Figure 3:
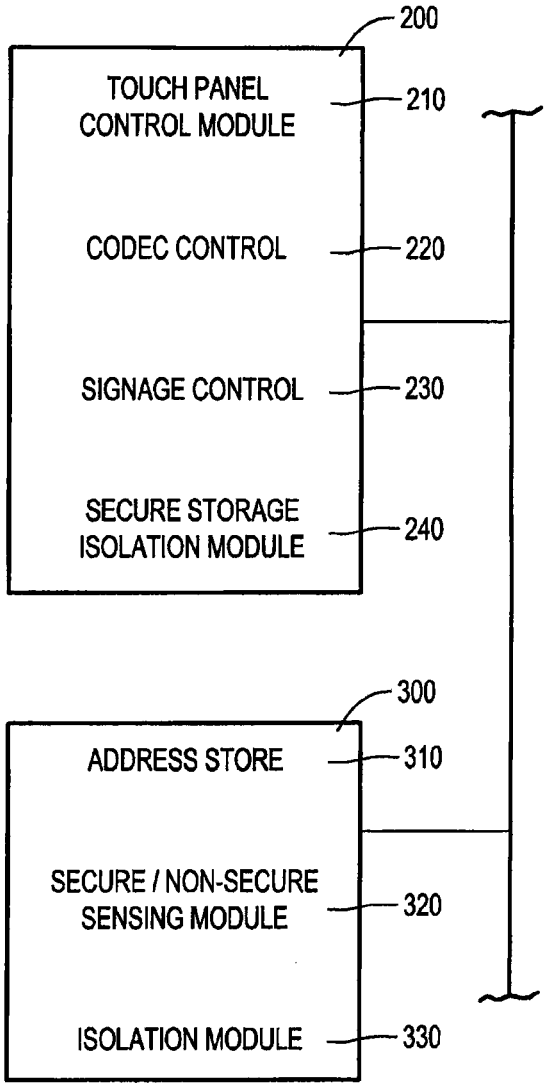
FIG. 3 is a block diagram illustrating various features of exemplary controllers used with the switching system of FIG. 2.

FIG. 3 is a block diagram illustrating various features of exemplary controllers (PRC 200 and SSC 300) used with the switching system 10. The PRC 200 and SSC 300, as well as the SSM 400 (not shown in FIG. 3) may include programming on a single processor or multiple processors. Multiple processors may be installed in the same physical platform or in separate platforms. The programming may be software that is loaded into memory. Alternatively, some or all of the programming may be implemented in hardware. In FIG. 3, programming components of the PRC 200 include the following modules: a touch panel control module 210 that implements the touch panel functionality, including communications between the touch panel 50 and other components of the switching system 10; a CODEC control module 220 that controls operation of the CODEC 410; signage control module 230 that controls the display shown on signage 60; and secure storage isolation module 240 that works in conjunction with the SSC 300 to ensure that the address data retained in the SSC 300 is never accessible from an outside network.

The SSC 300 includes the following programming modules: an address store 310 that maintains a persistent store of IP address and other related information, and that repopulates the CODEC 410 upon system 10 reboot; a secure/non-secure sensing module that senses when the system 10 is operating in a secure or non-secure mode, and when power is lost to certain components (e.g., the first switch, e.g., red switch, 420 or the second switch, e.g., black switch, 430) of the system 10; and isolation module 330 that isolates the SSC 300 from other components of the system 10 under defined operation conditions of the system 10.

The PRC 200 controls the transitioning of system 10 components, including changes in software states, power on/off, and network connection/cut-off. For example, to securely transition the CODEC 410 from unclassified to classified use, the CODEC 410 is placed in a transition state where it disconnects from the network and all residual information is removed. The processes by which this is accomplished is called periods processing. For a single CODEC and shared peripherals, on a classified CODEC the audio/video media stream is classified information. Other information such as IP addresses, address book entries, call logs and call data records are sensitive information that may be considered classified.

Software states include power up and power down. For power up, in addition to VTC calls, customers also use their VTC rooms for in-room meetings and briefings; therefore, the power up sequence defaults to network cut-off so as to prevent accidental or intentional connections from remote sites during secure or non-secure meetings.

Upon system power up, the following states are set:

TABLE 2

SOFTWARE STATE TABLE

| Switch | Description | Default Power-Up |
|---|---|---|
| Red, Ch1 | Red RS-530 | Cut-Off |
| Red, FOS, Ch2 | IP | Cut-Off |
| Black, Ch1 | Black RS-530 | Cut-Off |
| Black, Ch2 | Telephone | Non-Secure (B) or Cut-Off |

The default power-up state for the first switch, e.g., red switch, 420 channel 2 (Ch2) is Cut-Off; however, the default setting may be changed to Non-Secure so that scheduling, control, and administration on the CODEC 410 can still take place using remote management software. The default Power-Up can be altered depending on specific customer requirements.

During the system start-up phase the system 10 will go into Non-Secure mode by default. This will be indicated on the signage panel 60 and on the touch panel 50.

TABLE 3

SOFTWARE STATE TABLE

| Switch | Description | Default Start-Up |
|---|---|---|
| red, Ch1 | Red RS530 | Non-Secure (B) |
| red, FOS, Ch2 | IP | Non-Secure (B) |
| black, Ch1 | Black RS530 | Non-Secure (B) |
| black, Ch2 | Telephone | Non-Secure (B) |

Figure 4:
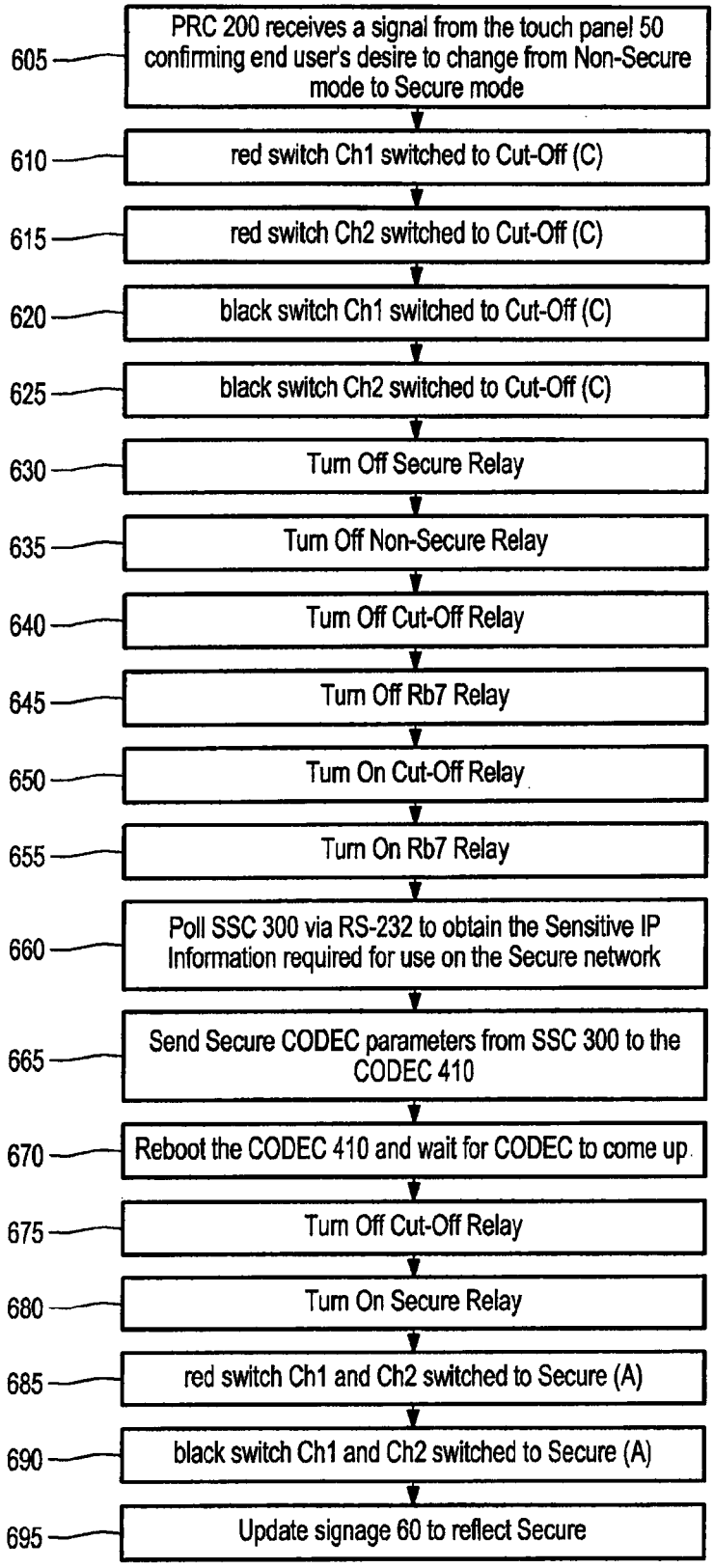
FIGS. 4 and 5 are flowcharts illustrating exemplary operations of the switching system of FIG. 2.
Figure 5:
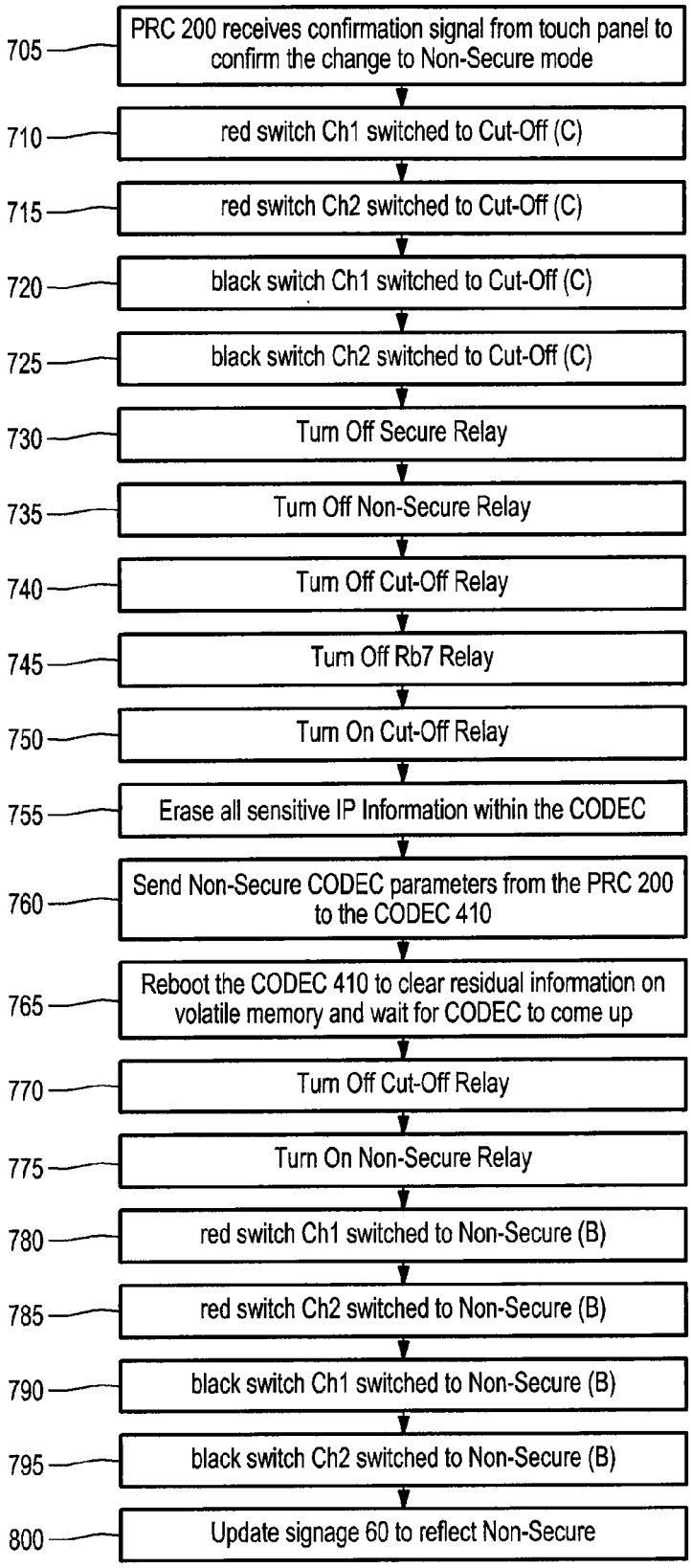

FIGS. 4 and 5 are flowcharts illustrating exemplary operations of the switching system 10. FIG. 4 illustrates an exemplary process 600 for switching from non-secure to secure mode with a flowchart representative of the computer program instructions. In the description of the flowcharts, the functional explanation marked with numerals in angle brackets, <nnn>, will refer to the flowchart blocks bearing that number.

The process begins, block <605>, when the PRC 200 receives a signal from the touch panel 50 confirming the end user's desire to change from non-secure mode to secure mode. Upon receipt of the confirmation signal in block <605>, the PRC 200 initiates a series of steps within the system 10, including:

<610>—red switch Ch1 switched to Cut-Off (C)<

<615>—red switch Ch2 switched to Cut-Off (C)<

<620>—black switch Ch1 switched to Cut-Off (C)<

<625>—black switch Ch2 switched to Cut-Off (C)<

<630>—Turn Off Secure Relay

<635>—Turn Off Non-Secure Relay

<640>—Turn Off Cut-Off Relay

<645>—Turn Off Communications Relay (Disengage comms between SSC 300 and PRC 200)<

<650>—Turn On Cut-Off Relay

<655>—Turn On Communications Relay (Engage comms between SSC 300 and PRC 200)

<660>—Poll the Secure Storage Controller (SSC) 300 via RS-232 to obtain the Sensitive IP Information required for use on the Secure network.

<665>—Send Secure CODEC parameters from SSC 300 to the CODEC 410. See Table 1 for a listing.

<670>—Reboot the CODEC 410 and wait for CODEC to come up

<675>—Turn Off Cut-Off Relay

<680>—Turn On Secure Relay

<685>—red switch Ch1 and Ch2 switched to secure (A)<

<690>—black switch Ch1 and Ch2 switched to secure (A)<

<695>—Update signage 60 to reflect SECURE

FIG. 5 illustrates an exemplary process 700 for switching from secure to non-secure mode with a flowchart representative of the computer program instructions. In the description of the flowcharts, the functional explanation marked with numerals in angle brackets, <nnn>, will refer to the flowchart blocks bearing that number:

In block <705>, the PRC 200 receives a confirmation signal sent by the user from the touch panel 50 to confirm the change to non-secure mode. The PRC 200 then initiates the following steps:

<710>—Red switch Ch1 switched to Cut-Off (C)<

<715>—Red switch Ch2 switched to Cut-Off (C)<

<720>—Black switch Ch1 switched to Cut-Off (C)<

<725>—Black switch Ch2 switched to Cut-Off (C)<

<730>—Turn Off Secure Relay

<735>—Turn Off Non-Secure Relay

<740>—Turn Off Cut-Off Relay

<745>—Turn Off Communications Relay (Engage comms between SSC 300 and PRC 200)<

<750>—Turn On Cut-Off Relay

<755>—Erase all sensitive IP Information within the codec

<760>—Send non-secure codec parameters from the PRC 200 to the CODEC 410. See Table 1 for a listing.

<765>—Reboot the CODEC 410 to clear residual information on volatile memory and wait for Codec to come up <770>—Turn Off Cut-Off Relay <775>—Turn On Non-Secure Relay <780>—Red switch Ch1 switched to non-secure (B)<

<785>—Red switch Ch2 switched to non-secure (B)<

<790>—Black switch Ch1 switched to non-secure (B)<

<795>—Black switch Ch2 switched to non-secure (B)<

<800>—Update signage 60 to reflect NON-SECURE

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "have," "having," "includes" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications, which do not depart from the spirit and scope of the invention, are deemed to be covered by the invention, which is limited only by the claims that follow. It should be understood that the embodiments disclosed herein include any and all combinations of features described in any of the dependent claims.

The invention claimed is:

1. A multi-class switching system, comprising:

a coder/decoder for converting voice between analog and digital;

a first switch coupled to the coder/decoder to isolate non-secure entities in a dial-up network and comprising fiber optic ports to pass classified and unclassified data to one of a classified IP network and an unclassified IP network;

an encryption device coupled to the first switch to encrypt digitized voice;

a second switch coupled to the encryption device and directly to the first switch, wherein the second switch receives encrypted digital voice from the encryption device connection and unencrypted digital voice from the direct connection, and wherein the first switch and the second switch operate in a plurality of states including secure, non-secure, and cut-off;

a fiber optic (F/O) switch coupled to the coder/decoder; and at least one controller that includes a state control module, power-on/off logic, network cut-off logic, remote control logic to control states of the first switch, the second switch, and the F/O switch, and that stores and retrieves sensitive coder/decoder parameters for operation of the coder/decoder and accesses the coder/decoder only when the first switch and the second switch both are in the cut-off state.

2. The multi-class switching system according to claim 1, wherein the first switch includes a red switch and the second switch includes a black switch.

3. The multi-class switching system according to claim 1, wherein the at least one controller includes a primary room controller having a state control module, power-on/off logic, network cut-off logic, and remote control logic to control states of the red switch, the black switch, and the F/O switch.

4. The multi-class switching system according to claim 1, wherein the at least one controller includes a secure storage controller that stores and retrieves sensitive coder/decoder parameters for operation of the coder/decoder, wherein the secure storage controller accesses the coder/decoder only when the red switch and the black switch both are in the cut-off state.

5. A multi-class switching system, comprising:

a coder/decoder for converting voice between analog and digital;

a single red switch coupled to the coder/decoder to isolate non-secure entities in a dial-up network and comprising fiber optic ports to pass classified and unclassified data to one of a classified IP network and an unclassified IP network;

an encryption device coupled to the red switch to encrypt digitized voice;

a black switch coupled to the encryption device and directly to the red switch, wherein the black switch receives encrypted digital voice from the encryption device connection and unencrypted digital voice from the direct connection, and wherein the red switch and the black switch operate in a plurality of states including secure, non-secure, and cut-off;

a fiber optic (F/O) switch coupled to the coder/decoder;

a primary room controller, comprising:

a state control module, power-on/off logic, network cut-off logic, and remote control logic to control states of the red switch, the black switch, and the F/O switch; and a secure storage controller that stores and retrieves sensitive coder/decoder parameters for operation of the coder/decoder, wherein the secure storage controller accesses the coder/decoder only when the red switch and the black switch both are in the cut-off state.

6. A method for utilizing a multi-class switching system, comprising:

utilizing a coder/decoder for converting voice between analog and digital;

passing classified and unclassified data to one of a classified IP network and an unclassified IP network with a first switch coupled to the coder/decoder to isolate non-secure entities in a dial-up network with fiber optic ports;

encrypting digitized voice with an encryption device coupled to the first switch;

receiving encrypted digital voice from the encryption device connection and unencrypted digital voice from the direct connection with a second switch coupled to the encryption device and directly to the first switch, wherein the first switch and the second switch operate in a plurality of states including secure, non-secure, and cut-off;

utilizing a fiber optic (F/O) switch coupled to the coder/decoder;

utilizing at least one controller that includes a state control module, power-on/off logic, network cut-off logic, remote control logic to control states of the first switch, the second switch, and the F/O switch;

storing and retrieving sensitive coder/decoder parameters for operation of the coder/decoder; and accessing the coder/decoder only when the first switch and the second switch both are in the cut-off state.

* * * * *